United States Patent [19]

Essig et al.

[11] Patent Number: 4,704,595

[45] Date of Patent: Nov. 3, 1987

[54] ELECTRICAL HEATING SYSTEM FOR A BIMETAL, PARTICULARLY FOR AN ELECTRICAL POWER CONTROL DEVICE

[75] Inventors: Willi Essig, Boeblingen; Siegfried Mannuss, Sternenfels, both of Fed. Rep. of Germany

[73] Assignee: E.G.O. Elektro-Geräte Blanc u. Fischer, Fed. Rep. of Germany

[21] Appl. No.: 837,526

[22] Filed: Mar. 7, 1986

[30] Foreign Application Priority Data

Mar. 8, 1985 [DE] Fed. Rep. of Germany ..... 3508248

[51] Int. Cl.[4] ..... H01H 61/02; H01H 63/013; H01H 71/16

[52] U.S. Cl. ..... 337/107; 337/102; 219/511

[58] Field of Search ..... 219/511, 512; 337/102-107

[56] References Cited

U.S. PATENT DOCUMENTS 3,846,726 11/1974 Hierholzer, Jr. et al. ..... 337/107

FOREIGN PATENT DOCUMENTS 1263945 9/1955 Fed. Rep. of Germany .
1665039 4/1966 Fed. Rep. of Germany .
7327063 6/1973 Fed. Rep. of Germany .
2625715 9/1976 Fed. Rep. of Germany .
2625716 9/1976 Fed. Rep. of Germany .
3143691 4/1981 Fed. Rep. of Germany .
786121 10/1955 United Kingdom .

*Primary Examiner*—Harold Broome
*Attorney, Agent, or Firm*—Steele, Gould & Fried

[57] ABSTRACT

A power control includes a thick film resistor on an electrically insulating support plate, for heating a bimetal strip operating switch contacts connecting power to a load, and to the resistor. The support plate is secured and the resistor thereon is electrically contacted by means of a resilient clip at one end, in the vicinity of a fixed end of the bimetal strip. An opposite end of the support is connected to a power source via a movable contact spring. An opposite free end of the bimetal strip acts directly on the switch contacts to disconnect power upon bending of the bimetal strip with heat. The bimetal strip and a control operator for biasing the bimetal strip are shaped like an L, with two legs pivotable around a pin adjacent the base of the bimetal strip.

16 Claims, 6 Drawing Figures

FIG. 1
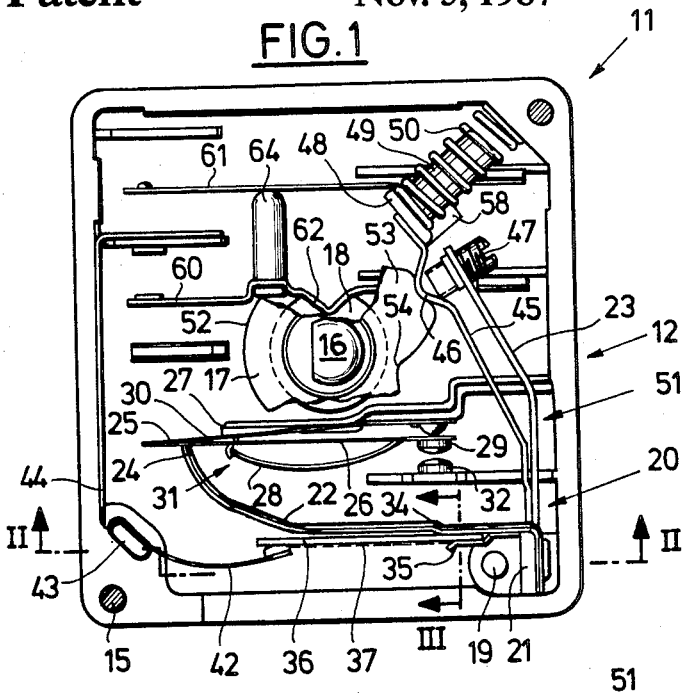
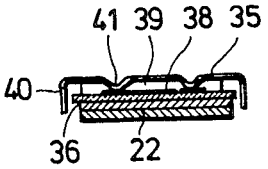
FIG. 3
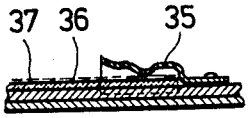
FIG. 4
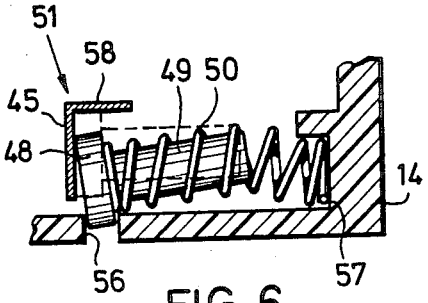
FIG. 6
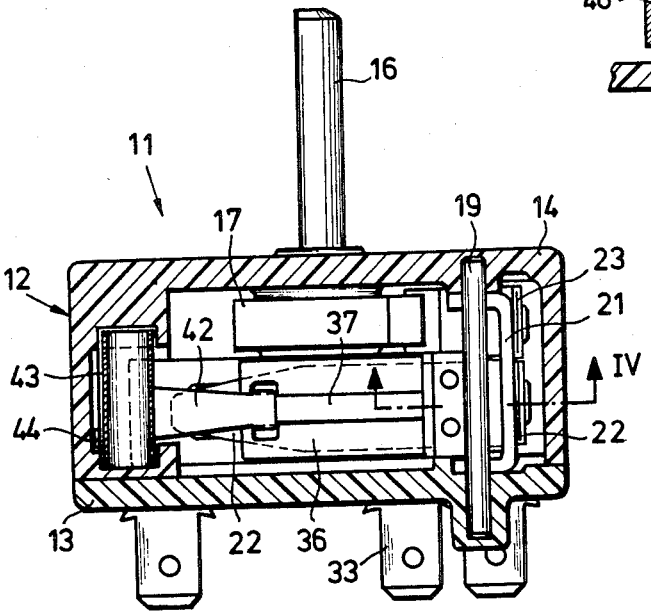
FIG. 2
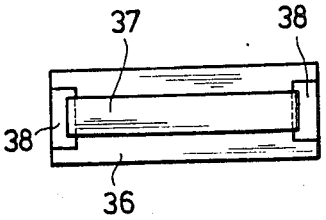
FIG. 5

ELECTRICAL HEATING SYSTEM FOR A BIMETAL, PARTICULARLY FOR AN ELECTRICAL POWER CONTROL DEVICE

The present invention relates to an electrical heating system for a bimetallic strip or bimetal, particularly for an electrical power control device.

An electrical power control device for electric heaters which supplies the consuming means with the power in individual power pulses of different relative on-times, is known from German patent No. 26 25 716. It has a bimetal constructed in the form of a bent or toggle lever acting with one end on an electrical snap or quick-break switch and onto whose longer bimetal operating leg arranged at right angles to the snap switch is wound an electric filament winding, whilst interposing small insulating plates. Due to the fact that it only has to absorb very low power levels, the electrical filament winding is made from very thin wire in the case of a control heating system connected parallel to the consuming means or load and whose fitting and contacting constitute a critical point in manufacture and operation. On one side, the bimetal operating leg is supported on the casing by means of a setscrew and at its other end acts via a pivot pin and the short bimetal leg to vary pressure on the switch. The switch is mounted in a pivotable manner and under the action of a control lever constructed as a compensation bimetal can be pivoted by a setting cam.

The problem of the invention is to provide an electrical heating system for a bimetal and therefore an improved power control device, which has a simple construction and has an improved operational reliability.

According to the invention this problem is solved by an electrical heating system in which close to one end of the bimetal is provided an electrically insulating support with an electric resistive film arranged thereon, being fixed by a clip and electrically contacted on one side. The support can be an electrically insulating, but relatively good heat conducting small ceramic plate, onto which is applied the resistive film, e.g. in the form of a so-called thick film resistor. At both ends of the resistive film contact surfaces can be applied to the support and are used for contacting purposes. The support is preferably arranged on the side of the bimetal with the material having the greater expansion coefficient and the bimetal can be largely straight preferably at ambient temperature in the area covered by the support. Thus, the bimetal bends away from the ceramic support, but at the start of the heating system is at a very limited distance therefrom. As preferably the end connected to the support is fitted optionally in articulated manner to a casing, there is a so-called root heating of the bimetal, i.e. the latter is heated to the greatest extent in the area opposite to its free end acting on the switch, so that through leverage there is a particularly marked deflection.

The clip can be a preferably pocket-shaped spring metal part fixed to the bimetal and which has in particular lateral guidance edges. Thus, during fitting, said support can be more easily fitted into said pocket and is therefore automatically contacted on one side. At the end located at the other support end the resistive film can be contacted by a contact spring with a transfer contact. This relatively light, thin contact spring easily gives way to the movements of the bimetal and therefore the support and is adequate for transferring the limited heating current of the bimetal. At its end opposite to the transfer contact, the contact spring can be shaped to a preferably oval cylinder and is fixed in at least one corresponding casing opening. Thus, a non-rotary pin is obtained, which secures the contact spring in the desired position on the casing.

The preferably curved free end of the bimetal can act directly on the actuating point of a snap switch. Thus, there is no need for a transfer lever or the like. A snap switch can be used, whose snap spring is fitted to a flexible spring support and by bending the latter is actuated relative to a spring tongue supported on a fixed part.

The electrical heating system makes it possible to produce a particularly advantageous power control device, in which the bimetal forms a leg of a bent lever pivotably mounted close to its knee and on whose other leg acts a setting cam. This bent lever leg can comprise two approximately parallel strips, whereof one is formed by a compensation bimetal and which is preferably supported on the other strip by means of a setscrew. This leads to a jointly pivotable unit constituted by the operating bimetal and the compensation bimetal, which only requires one swivel bearing for all the movements acting on the snap switch (operating path of the bimetal, compensation path and adjustment path of the setting cam).

A non-positive pressing of this bent lever on the adjusting cam is advantageously caused by a helical spring. In order to facilitate fitting, the latter can be arranged on a preferably bolt-like guidance part which, during fitting, is engageable behind a casing shoulder, preferably a casing slot with a tensioned helical spring deflected from its central axis and is disengageable on actuating the bent lever. Thus, by means of the bolt the tensioned helical spring is fixed in the slot. During the first actuation of the setting cam, which takes place at the time of setting, the bolt holding the helical spring is automatically disengaged from the slot and brings the spring into the operating position. This preferred fitting mode can also advantageously be used in connection with other parts of switches or equipment.

The power control device can contain disconnection and/or signal contact springs, which are approximately parallel to one another. One of the contact springs with the power control device in the "off" state is located in a depression of an index cam and preferably acts via an insulating contact piece on the other contact spring or several contact springs. On the one hand this leads to a space-saving fitting of the contacts used for signal contact making or bipolar disconnection and which are manually operated on switching on the power control device and on the other hand the contacts are in the unloaded state and are consequently not subject to fatigue in the "off" state, i.e. most of the time.

Features of preferred further developments of the invention can be gathered from the subclaims, description and drawings, the individual features being realizable individually or in the form of subcombinations relative to an embodiment of the invention. An embodiment of the invention is described in greater detail hereinafter relative to the drawings, where in show:

FIG. 1 A plan view of a power control device with the cover removed.

FIG. 2 A section along line II—II of FIG. 1.

FIG. 3 A greatly enlarged detail section along line III of FIG. 1.

FIG. 4 An enlarged detail section along line IV in FIG. 2.

FIG. 5 A plan view of a resistor core.

FIG. 6 A part sectional detail of the helical spring shown in the top right of FIG. 1.

The represented power control device 11 has a casing 12 comprising a casing base plate 13 and a casing cover 14. They are made from thermosetting plastic and can be screwed together at two corners by means of screws 15. An adjusting shaft 16 is mounted in both casing parts and carries a setting cam 17 and an index cam 18. A bent lever 20 is pivotably mounted about a pivot pin 19 in one casing corner and carries on a U-shaped shaft bracket 21 an operating bimetal 22 and a compensation bimetal 23, which are displaced with respect to one another in the longitudinal direction of the axis and are rivetted to said bracket 21. The operating bimetal 22 firstly extends substantially straight and approximately parallel to one casing side and then is bent into a curve toward the center of the casing. By its free end 24, it presses against the actuating point 25 of a snap switch, whose snap spring 26 has a spring tongue 28 bent therefrom and supported on a fixed support 27 and at its end remote from the operating contact 29 is connected to a flexible snap spring support 30 in the vicinity of the operating pressure point 25. Snap switch 31 is positioned approximately parallel to the main extension of the operating bimetal 22 between the latter and the adjusting shaft 16 or the index cam 18 arranged thereon. Operating contact 29 cooperates with a fixed opposing contact 32, which is connected through the casing base plate, like the other switch connections, to flat plug-in tongues, which project at right angles from the back of the switch, i.e. the outside of base plate 13. It is also possible to use other snap switch types, which make it possible to provide changeover contacts, if required.

As can in particular be seen from FIGS. 3 to 5, in the vicinity of the root of operating bimetal 22, i.e. its end fixed to the shaft bracket 21, is fitted thereto a spring metal clip 35 by spot welding. On the bimetal surface facing the casing side and which is made from the material with the higher expansion coefficient, the clip forms a pocket, into which can be inserted one end of a support 36, which comprises a sheet or strip of electrically insulating ceramic material having good heat conducting properties. At its end remote from the bimetal, the support carries an electrical resistive film 37 in the form of a strip running along the support, which is indicated by a broken line in FIGS. 1 and 4. Two metallic contact faces 38 are applied to the two narrow sides of the elongated, rectangular support and the resistive film 37 extend up to these and is consequently connected in electrically conductive manner thereto. The resistive film 37 can comprise a per se known thick film resistor, e.g. based on bismuth or $Ru_2O_7$, whilst the support can be made from $Al_2O_3$. The pocket 39 formed by clip 35 extends over the entire width of the operating bimetal 22 and the approximately equally wide support 36, whilst having lateral bends 40 guiding support 36. Two stamped projections 41 in clip 35 press on one of the contact bases 38 and thus ensure a reliable hold and good contacting. Thus, the root of the support is in contact with bimetal 22 and, following an offset 34 in the bimetal, is secured parallel and with a limited spacing with respect therefrom, at least at ambient temperature, when the bimetal is substantially straight in this zone. On heating, the bimetal admittedly bends away from the support, but receives adequate radiant heat at the higher temperatures, so that there is still an adequate heat transfer. However, it is important that there is a rapid response in the lower temperature range due to the good contacting.

The other end of support 36 is contacted by a thin contact spring 42, whose laterally bent ends rest on a contact base 38. The contact spring material is widened at the fixed end and rolled to form an oval cylinder 43, positioned in corresponding recesses of casing parts 13, 14 and positioning the contact spring. The power supply is provided via a welded wire 44 from a connection tongue. Thus, the contact spring forms a connection moving with the end of the support, which keeps its contact face clean due to this movement.

Initially the compensation bimetal 23 is approximately at right angles to the operating bimetal 22 and then bends somewhat in the direction of the centre of the switch. A sheet metal spring strip 45 is fitted parallel thereto in the vicinity of shaft bracket 21 and has a V-shaped bulge 46, in which engages an adjusting screw 47 screwed into the free end of the compensation bimetal. Screw 47 makes it possible to adjust compensation bimetal 23 and strip 45 with regards to their reciprocal spacing for setting the power control device. On the free end of strip 45 presses a head 48 of a bolt 49, which projects diagonally out of a casing corner and guides on its shank a helical spring 50, which presses into contact with the setting cam 17 the leg 51 of bent lever 20 with bulge 46 formed from compensation bimetal 23 and strip 45. For the continuous setting of the power control device, the setting cam has a spiral outer surface 52, which terminates in its larger radius portion in a projecting cam 53, which contains a locking recess for receiving the bulge 46 for the off-state of the power control device 11 shown in FIG. 1. At the smallest radius cam end is provided a depression 54, which ensures a reliable control of the maximum power (100% relative on-time).

As one end of helical spring 50 is supported in cover part 14, but fitting starts from the casing base plate 13, it would apparently be necessary to bias the helical spring with a special fitting means. However, this is advantageously avoided in that, as shown in FIG. 6, casing cover 14 has a slot 56, into which can be pressed during the initial assembly head 48 of bolt 49. Helical spring 50 is bent somewhat out of its straight position, because its one end is fixed in a casing depression 57, so that it is secured in the tensioned state. When the free end of strip 45 presses for the first time against head 48 on pivoting the setting cam into the position shown in FIG. 1, then head 48 is released from its secured position and under the stretching effect of the helical spring automatically jumps into its operating position shown in broken line form in FIG. 6. It is thereby positioned by a bend 58 of strip 45.

On the adjusting shaft side opposite to the operating bimetal 22 and the snap switch 31, the casing contains two contact springs 60, 61, which carry at their free ends contacts for signal contact making or disconnecting the second pole of the domestic mains. The self-resilient contact springs are fitted at one side to holders in one piece with the flat plug-in tongues inserted in the casing. The contact spring 60 close to the adjusting shaft has a bulge 62, which runs onto the index cam 18 and in the represented off-state of the power control device 11 is located in a corresponding depression of index cam 18, is consequently relieved and the contacts of both contact springs 60, 61 are open. The contact spring 61 for signal contact making, i.e. indicating whether the power control device is switched on, is operated by an insulating pressure piece 64, which is fixed to contact spring 60. Apart from the depression, index cam 18 has a concentric outer face.

Operation corresponds to that of a power control device. If, on switching on, by rotating the adjusting shaft in FIG. 1 clockwise bulge 46 comes out of its detention point, so that the user has to overcome a resistance, then the bent lever is pivoted counterclockwise to the desired set value, so that the operating bimetal 22 presses its free end 24 against snap spring support 30, urging it to pivot counterclockwise. As a result the snap switch 34 closes the previously open contacts 29, 32 on snapping over of snap spring 26 and a connected load receives power in the same way as the resistive film 37, which is connected in parallel to the load, i.e. is operated with the full mains voltage. It heats support 36 and the latter heats the operating bimetal, so that it is deflected and its end 24 again presses to a greater extent against the operating pressure point 25 of snap switch 31, so that after some time the latter is opened again. Following a corresponding cooling time, the switching cycle starts anew. The reaction time can easily be determined by the thickness and coupling of support 36. The power supply of the bimetal heating system formed by the resistive film 37 and fixed by clip 35 is provided by means of the operating bimetal contact with the live snap switch. The compensation bimetal 23 bends in accordance with the ambient temperature and compensates the same.

On switching on contact spring 60 and with it contact spring 61 via pressure piece 64 would be pressed upwards (cf. FIG. 1) and consequently the contacts would be closed.

The described bimetal heating system is particularly suitable for a power control device, but can also be used for other equipment in which it is a question of an advantageous heating of a bimetal or similar part, e.g. in thermal time switches.

Through the position and size of offset 34 of operating bimetal 22, it is possible to determine the desired thermal degree of coupling of the heating to the bimetal, in order e.g. to vary the switching frequency. The support and bimetal could engage with one another over most of the heating range.

We claim:

1. An electrically heated bimetallic device, comprising:

a bimetal strip and a control responsive to said bimetal strip, the bimetal strip bending with heat to operate a control;

means for heating the bimetal strip including an electrically insulating support shaped like a strip, the support having an electric resistive film coated thereon, the bimetal strip and the support being substantially parallel; and, a clip disposed adjacent one end of the bimetal strip, attaching the bimetal strip to the support and electrically contacting the resistive film, an other end of the bimetal strip being moved with deformation of the bimetal strip to operate the control.

2. The device according to claim 1, wherein the clip is a spring material and is fixed to the bimetal strip and forms a pocket shape with lateral guidance edges for receiving the support.

3. The device according to claim 1, wherein contact areas for electrical contacts are applied to the support and are connected to both ends of the resistive film, the film being a thick film coating.

4. The device according to claim 1, wherein at an end of the support opposite to the clip the resistive film is electrically contacted by a contact spring.

5. The device according to claim 4, further comprising a casing, and wherein the contact spring is fixed at a first end to an oval cylinder and bears on an opposite end against the resistive film, said first end of the contact spring being secured in at least one corresponding opening of the casing.

6. The device according to claim 1, further comprising a casing, and wherein the end of the bimetal strip attached to the support is fitted to the casing.

7. The device according to claim 1, wherein the bimetal strip comprises two layers of material of higher and lower thermal expansion coefficient, respectively, the support being arranged on a side of the bimetal strip consisting of material of one of the layers having the higher expansion coefficient, whereby with heating the bimetal strip is urged to curve away from the support.

8. The device according to claim 1, wherein at ambient temperature a zone of the bimetal strip is covered by the support, the support engaging the bimetal strip adjacent an area of the bimetal strip in which the support is fixed to the bimetal strip, and the support extends over a further, larger part of its length, substantially parallel and at a limited distance from the bimetal strip.

9. The device according to claim 1, wherein the control has a set of electric contacts forming a snap switch and a curved free end of the bimetal strip acts directly on an actuating point of the snap switch.

10. An electrical control device, comprising:

a housing;

an L-shaped lever having two legs joined at a knee, the L-shaped lever being movably mounted in the housing to pivot adjacent the knee;

a switch with electric contacts;

a bimetal strip with an electrical heating means, the bimetal strip being disposed on one of the two legs, the bimetal strip tending to bend with heat and thereby to operate the switch; and, a setting cam for setting electrical power, the setting cam bearing against an other of the two legs and being operable to pivot the L-shaped lever and to controllably urge the bimetal strip against the switch.

11. The control device according to claim 10, wherein said other of the two legs of the L-shaped lever comprises two approximately parallel strips, whereof one of the strips is a compensation bimetal and is supported on the other of the strips by means of an adjusting screw.

12. The control device according to claim 10, further comprising a helical spring for acting on one leg of the L-shaped lever, the one leg being arranged on a guidance part which is engageable behind a shoulder defined by the casing, with a tensioned helical spring deflected from its central axis to set the guidance part behind the shoulder, and the guidance part is disengageable from the shoulder on actuating the L-shaped lever.

13. The control device according to claim 10, further comprising disconnection springs, which are approximately parallel to one another, and wherein one of the disconnection springs in an "off" state of the control device is located in a depression of an index cam and acts via an insulating contact piece on another of the contact springs.

14. The control device according to claim 10, further comprising signal contact springs, which are approximately parallel to one another, and wherein one of the signal contact springs in an "off" state of the control device is located in a depression of an index cam and acts via an insulating contact piece on another of the contact springs.

15. An electric power control, comprising:

a housing;

switch contacts in the housing for periodically connecting and disconnecting a load and a source of electric power;

a control lever shaped like an L, with two legs joined at a knee, the control lever being pivotable in the housing around an axis adjacent the knee, one of the two legs having a bimetal strip bearing against the switch contacts to operate the switch contacts and an other of the two legs being movable around the axis to control positioning of said one of the two legs, power to the load being disconnected by pressure of said one of the two legs against the switch contacts, said one of the two legs having a bimetal strip whereby pressure against the switch contacts changes with heat; and, an electrically heatable resistive film strip mounted by one end on the bimetal strip adjacent the knee of the control lever, the resistive film being electrically connected in parallel with the load.

16. The electric power control of claim 15, further comprising a setting cam operable to position the other of the two legs of the control lever.

* * * * *